US005275382A

United States Patent [19]

Charbaut et al.

[11] Patent Number: 5,275,382

[45] Date of Patent: Jan. 4, 1994

[54] FENCE POST

[75] Inventors: Gerard L. D. Charbaut, Dormans; Jean Michel Y. L. Gaultier, Laval, both of France

[73] Assignee: Dirickx, Renaze, France

[21] Appl. No.: 789,337

[22] Filed: Nov. 8, 1991

[30] Foreign Application Priority Data

May 15, 1991 [FR] France ..... 91 05902

[51] Int. Cl.[5] ..... E04H 17/12

[52] U.S. Cl. ..... 256/48; 256/53; 256/58; 256/DIG. 5

[58] Field of Search ..... 256/48, 47, 53, DIG.; 52/660, 794, 153-; 47/44

[56] References Cited

U.S. PATENT DOCUMENTS

| | | | |
|---|---|---|---|
| 870,352 | 11/1907 | Fitzgibbon | 52/154 |
| 1,464,326 | 8/1923 | Lindstrom et al. | 52/153 X |
| 1,636,126 | 7/1927 | Christenson | 52/153 X |
| 3,411,754 | 11/1968 | Fahrenholz | 256/48 |
| 3,776,522 | 12/1973 | Bartlett | 256/47 |
| 4,073,112 | 2/1978 | Leiblich | 256/32 X |
| 4,294,430 | 10/1981 | de Jager | 256/48 X |
| 4,503,636 | 3/1985 | Stuckey | 256/48 X |

FOREIGN PATENT DOCUMENTS

| | | | |
|---|---|---|---|
| 2316414 | 1/1977 | France . | |
| 2372296 | 6/1978 | France . | |
| 2507660 | 12/1982 | France . | |
| 2509356 | 1/1983 | France | 256/1 |
| 2620754 | 3/1989 | France . | |

*Primary Examiner*—Randolph A. Reese
*Assistant Examiner*—Harry C. Kim
*Attorney, Agent, or Firm*—Wenderoth, Lind & Ponack

[57] ABSTRACT

A fence post, comprising a vertically elongated anchoring member having a front face, and a vertically elongated fence holding foot projecting outwardly from the front face of the anchoring member. The fence holding foot is substantially T-shaped in a horizontal plane and comprises two lateral arms and a substantially perpendicular base. The two lateral arms are spaced apart from the front face of the anchoring member by the base. The opposite ends of the two lateral arms include flanges opening towards the front face of the anchoring member. The lateral arms also include a plurality of slots extending horizontally through the flanges at spaced locations along their vertical length. The anchoring member preferably has a shape of an isosceles trapezium in a horizontal plane. The fence post is preferably formed from a single piece of metal.

9 Claims, 5 Drawing Sheets

FENCE POST

The present invention relates to improved metal fence posts, the design of which facilitates manufacture, installation and use.

BACKGROUND OF THE INVENTION

Various types of metal fence posts have already been proposed.

Some of them take a similar form to a railway rail of extruded aluminium, made with a virtually circular head having a web terminating in a foot, the flanges of which are cut away. This type of post is relatively expensive, of low strength and does not permit easy installation, in particular of latticework fence panels.

Others consist of a hollow bar with a triangular cross-section, one of the sides of which is split over its entire length, parallel to the edges of the prism, and the flanges of which are grooved. Although this latter solution permits the use of latticework fence panels, it does not enable them to be fastened reliably and with varying orientations and, furthermore, does not make it possible to use substructures, for example prefabricated sheet piles.

The object of the invention is to provide an improved metal fence post which does not have the disadvantages, mentioned in brief, of those mentioned above, and which is extremely simple to manufacture and use.

SUMMARY OF THE INVENTION

The subject of the invention is an improved metal fence post which is characterised in that it comprises a framework or anchoring member with a cross-section in the shape of an isosceles trapezium, a T-shaped foot or fence holding means with a central web or base connected to the large base or front face of the framework and virtually perpendicular at its centre to this framework, and with two lateral arms ending in flanges inclined in a V-shape relative to each other and pointing towards this large base. This post is also notable in that equidistant grooves are cut into each flange so as to form regularly distributed tongues, and in that each tongue terminates in a hook which is open towards the web and has a rim virtually parallel to the large base in order to define a longitudinal U-shaped throat.

Other features of the invention will become apparent upon reading the description and the claims which follow, and from examining the attached drawing, given merely by way of example, in which:

DESCRIPTION OF THE PREFERRED EMBODIMENTS

Figure 1:
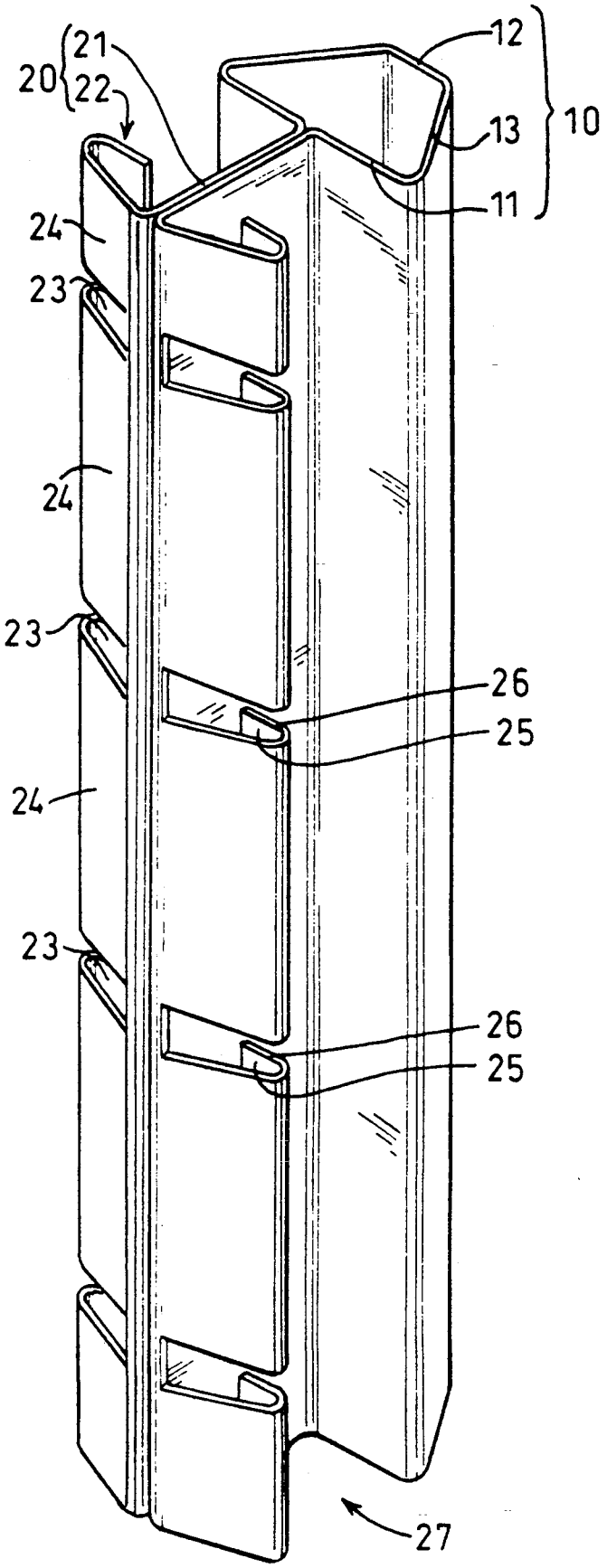
FIG. 1 is a partial perspective view of an embodiment of an improved metal fence post according to the invention.

Since the manufacturing techniques of metal fence posts are well known from the prior art, only that which concerns the invention directly or indirectly will be described in what follows. For the remainder, the person skilled in the art in question will employ the existing conventional solutions available to him in order to deal with the particular problems with which he is faced.

In what follows, an identical reference numeral will always be used to identify an identical element, irrespective of the embodiment.

For the sake of ease of explanation, the structure of an improved metal fence post according to the invention will be described successively before explaining its use and the manufacturing technique.

As can be seen, in particular in FIG. 1, an improved metal fence post according to the invention essentially comprises a framework 10 and a foot 20.

The framework 10 takes the form of a truncated prism with a cross-section in the shape of a trapezium, preferably an isosceles trapezium, with a large base 11, a small base 12 and sides 13.

The foot 20, approximately in the shape of a T, is provided with a central web 21 connected to the large base 11 of the framework 10 so as to be virtually perpendicular to the latter at its centre. The foot 20 also has two lateral flanges 22, inclined in a V-shape relative to each other and pointing towards the large base 11.

As can be seen, equidistant, and preferably opposing grooves 23 are cut into each flange 22 so as to form thereby regularly distributed tongues 24. As may be observed, each tongue 24 terminates in a hook 25 which is open towards the web 21. Each hook 25 has a rim 26 virtually parallel to the large base 11 in order to define, with the latter, an approximately U-shaped longitudinal throat 27, the bottom of which consists of the web and the two arms of which consist of the rims and part of the large base facing it.

As may be observed, the framework 10 is preferably hollow.

As may also be observed, the post according to the invention is made in a single piece from a metal sheet or from a bent and cut-away steel strip.

A galvanised steel will, for example, be used in which grooves are made, for example by "notching", and which is cold-formed and then cut to length. If necessary, the galvanised steel is covered with a plastic coating of high adhesiveness.

It will be understood that such a technique makes it possible to manufacture posts of varying "above-ground" useful heights very easily and also, for such a useful height, various sizes of bases for deep anchorages in the earth or for short anchorages in low walls or substructures. In order to do this, all that is required is for the length of each post according to the invention to be adapted.

The trapezoidal cross-section used is oriented towards the outside of the post, as depicted, so as to obtain a high bending strength. The moment of inertia I/V is of the order of 6.70 $cm^3$. The tongues are preferably symmetrical, and the pitch of the grooves is approximately 100 Mm.

The throats or recesses permit the laying of sheet piles, substructures or the like.

Figure 3:
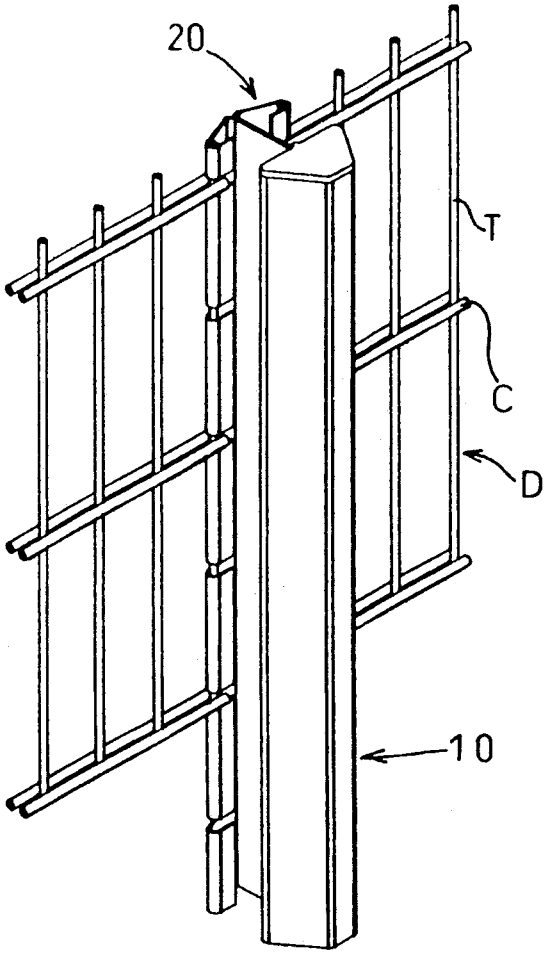
Figure 2:
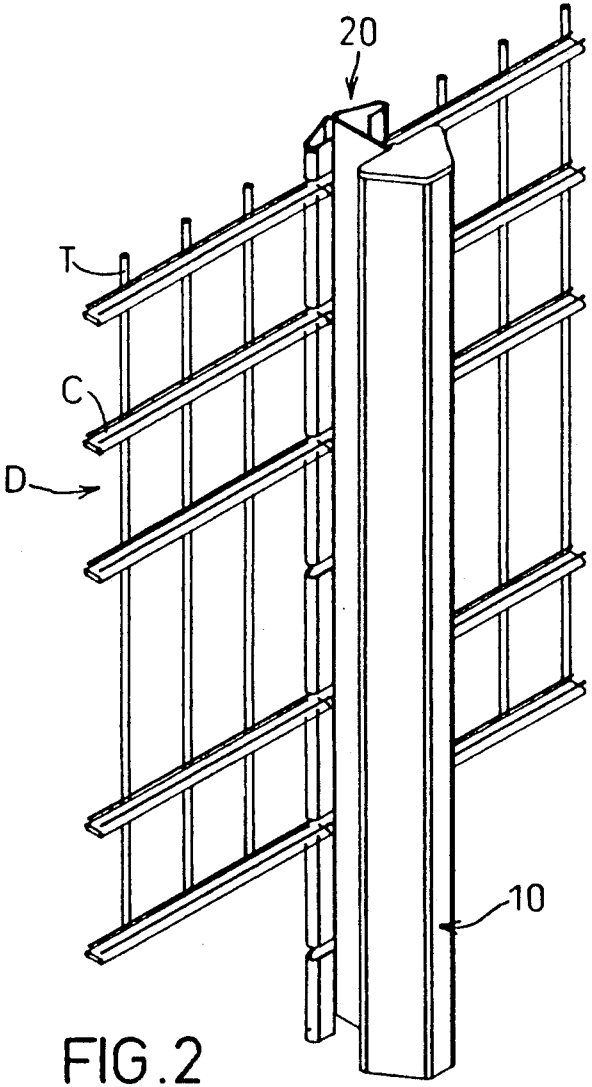
FIG. 2, 3, 4, 5 are illustrations of the manner in which the improved fence post according to the invention is used with welded-latticework fence panels of different types.
Figure 5:
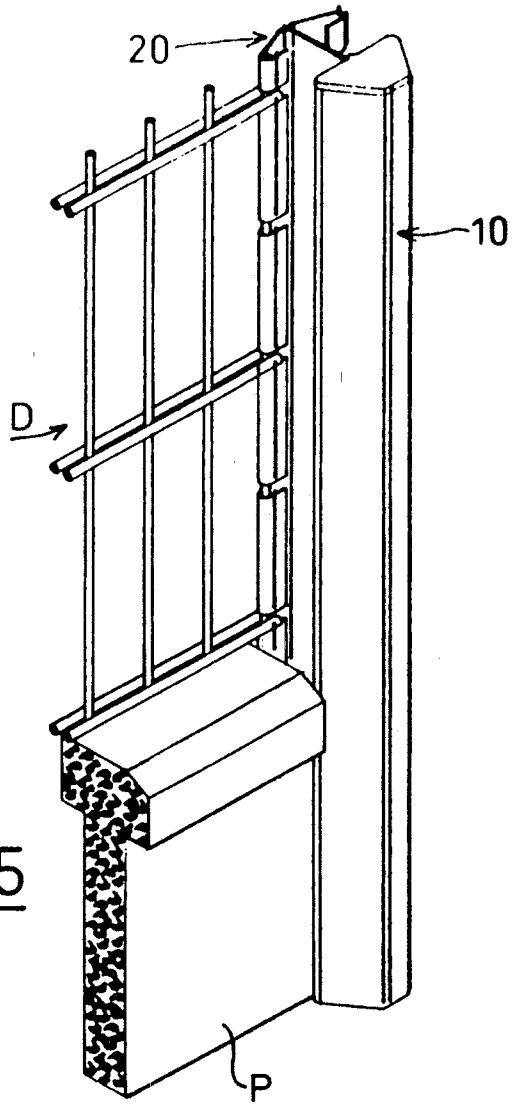
Figure 4:
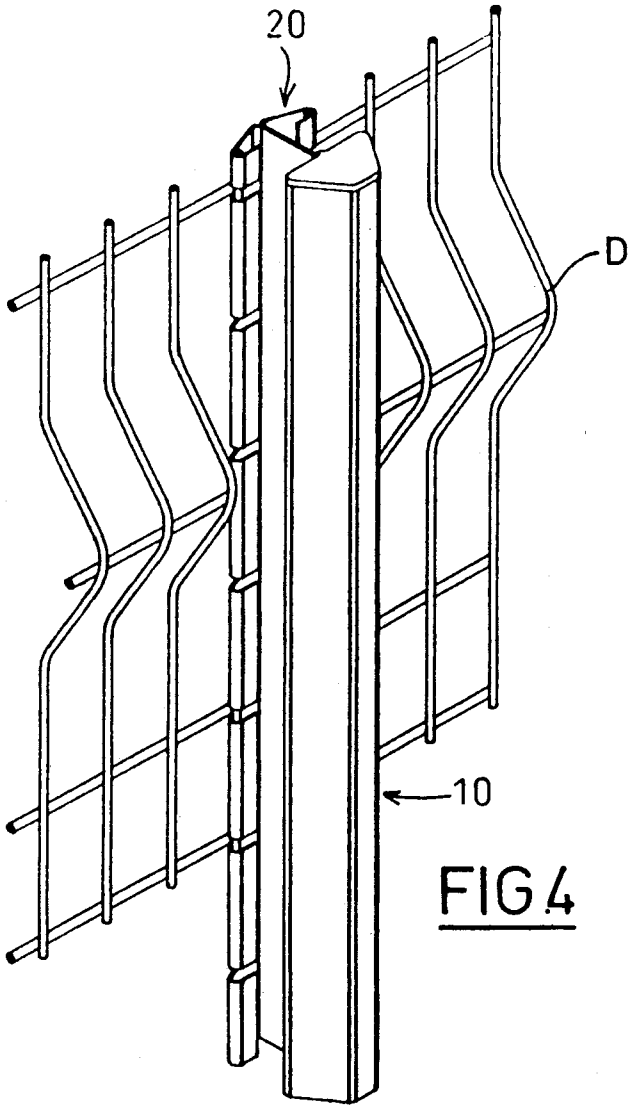
Figure 6:
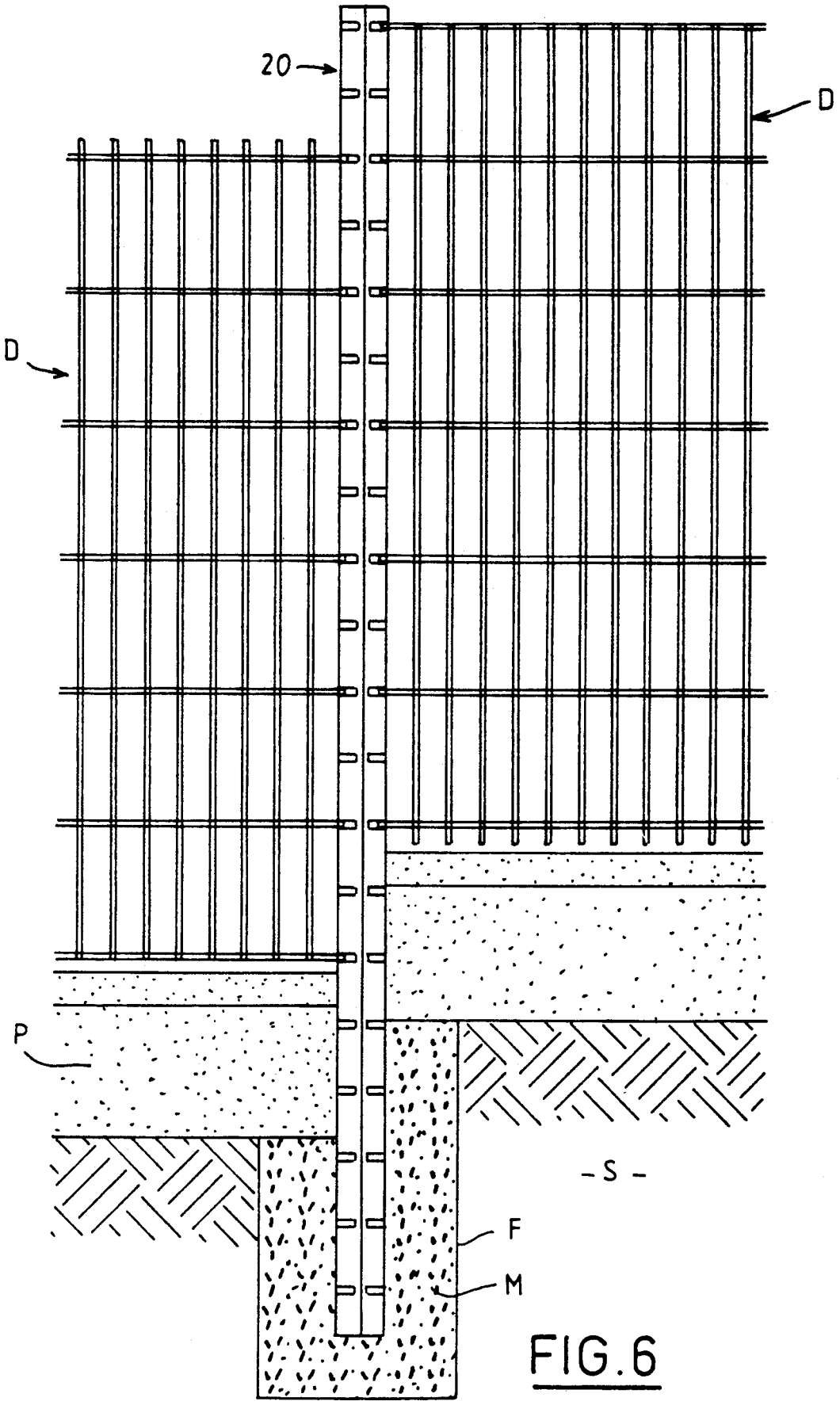
FIG. 6 is a view in elevation showing the use of an improved fence post according to the invention in the case where there is a shift in level.

Reference will now be made to FIG. 2, 3, 4, 5 and 6 which make it possible to understand the way in which an improved metal fence post according to the invention is used. A trench F is made in the ground S, and the posts are anchored there with the aid of mortar M, for example. Where necessary, the substructure boards P are used and laid by insertion into the throats 28. Welded-latticework panels D are used, for example, the latticework being made from horizontal wires C and vertical wires T. As may be observed, the horizontal wires can take the form of bars (FIG. 2) or double wires (FIG. 3). The vertical wires can be curved, as illustrated in FIG. 4.

Figure 7:
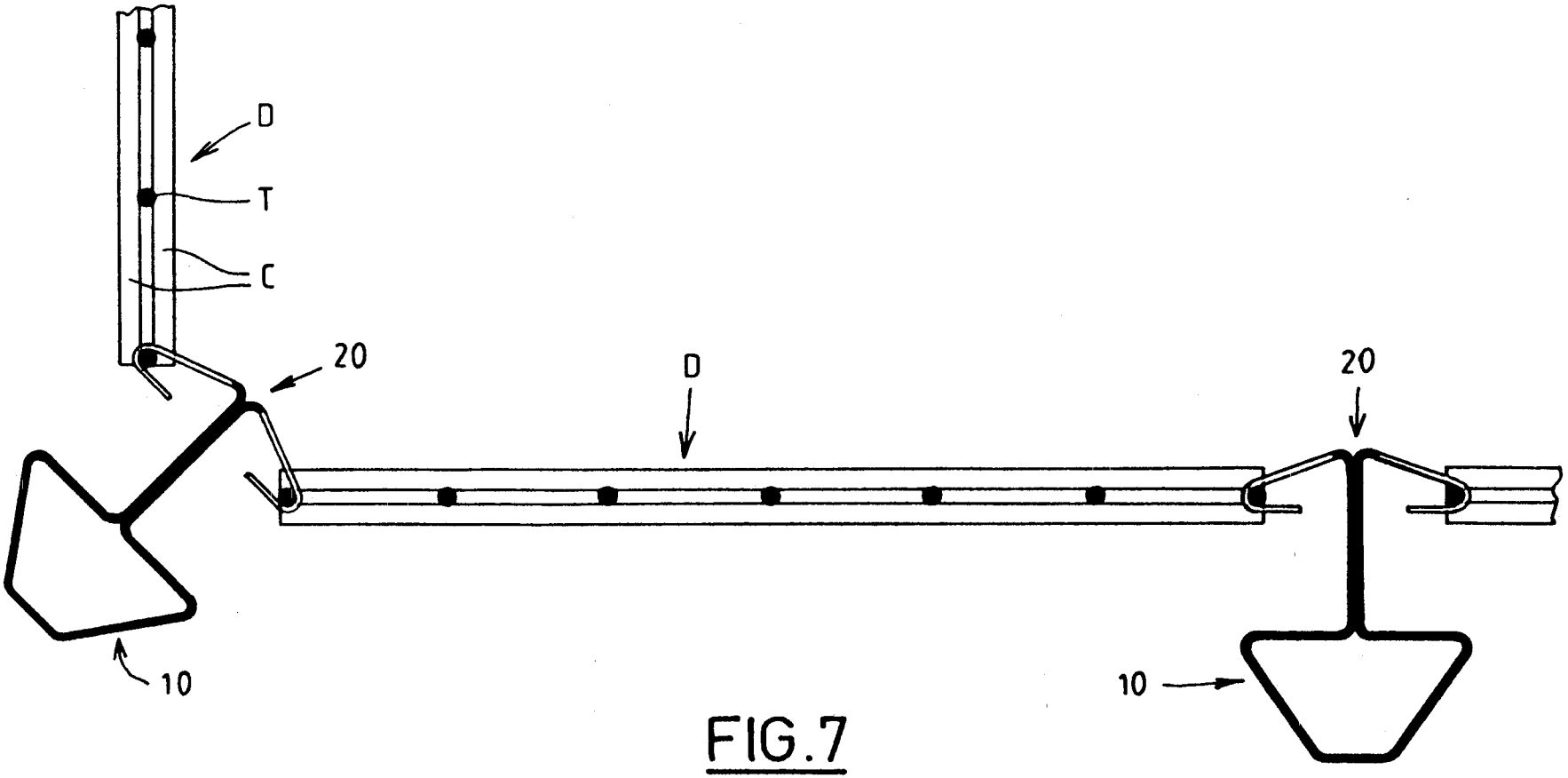
FIG. 7 is a diagrammatic top view showing the way in which an improved metal fence post according to the invention permits changes in direction.

FIG. 7 shows the way in which changes in direction can be obtained with corners which vary with the large amplitudes.

As can be seen in this Figure, when the vertical wires T of each end of a panel D are engaged in the hooks 25, they form therewith d sort of hinge which enables the panels to be oriented easily, in particular in order to follow, as desired, the abrupt changes in direction of a property boundary, for example. As may be observed, in particular, in FIG. 7, the posts according to the invention are such that the geometrical axis of such a hinge is virtually in line with, or even outside, the corners of the large base 11 of the trapezoidal cross-section; by adopting such a configuration, a possible range of deflection of the orientation of the panels is obtained of the order of approximately 90° on either side of their median position, when they are virtually parallel to the large base.

Where necessary, these posts are topped with a cap piece, for example made from plastic, in order to seal the orifice of the upper part of the framework.

Using latticework panels 1 m or 2 m high and 2.0 m or 2.3 m long, with a pitch of 200 Mm, and using six types of panels, it can be seen that it is possible to obtain more than sixty different solutions of fences, depending upon the wishes of the user, and this is achieved with the aid of a very small number of basic components.

The entire practical interest of the present invention can be understood, in particular in terms of the ease of manufacturing a fence post, and the convenience of its use, which permits easy and reliable fastening of latticework panels of varying meshes.

We claim:

1. A fence post, comprising:

a vertically elongated anchoring member having a front face, and a vertically elongated fence holding means projecting outwardly from said front face of said anchoring member, said fence holding means being substantially T-shaped in a horizontal plane and comprising two lateral arms having opposite ends and a substantially perpendicular base, said two lateral arms spaced apart from said front face of said anchoring member by said base, the opposite ends of said two lateral arms including flanges opening towards said front face of said anchoring member, said lateral arms including a plurality of slots extending horizontally through said flanges at spaced locations along their vertical length.

2. The fence post according to claim 1, wherein said anchoring member has a shape of an isosceles trapezium in a horizontal plane.

3. The fence post according to claim 2, wherein said front face of said anchoring member is the base of said isosceles trapezium.

4. The fence post according to claim 1, wherein said anchoring member is hollow.

5. The fence post according to claim 1, wherein said anchoring member and fence holding means are formed from a single piece of metal.

6. The fence post according to claim 1, wherein said plurality of slots are spaced at equal distances from each other along the vertical length of each flange.

7. The fence post according to claim 1, wherein said plurality of slots of each flange are spaced in the same horizontal planes.

8. The fence post according to claim 1, wherein said flanges are substantially V-shaped in a horizontal plane.

9. The fence post according to claim 1, wherein said front face of said anchoring member, said perpendicular base and each of said lateral arms form a substantially U-shaped arrangement in a horizontal plane.

* * * * *